US005752855A

United States Patent [19]

Mehez et al.

[11] Patent Number: 5,752,855

[45] Date of Patent: May 19, 1998

[54] BRANCH CONNECTOR DEVICE FOR A SHIELDED CABLE

[75] Inventors: Michel Mehez, Sucy En Brie; Bernard Warusfel, Vanves, both of France

[73] Assignee: Cegelec, Levallois Perret, France

[21] Appl. No.: 682,727

[22] PCT Filed: Dec. 14, 1995

[86] PCT No.: PCT/FR95/01672

§ 371 Date: Jul. 26, 1996

§ 102(e) Date: Jul. 26, 1996

[87] PCT Pub. No.: WO96/19020

PCT Pub. Date: Jun. 20, 1996

[30] Foreign Application Priority Data

Dec. 14, 1994 [FR] France ..... 94 15063

[51] Int. Cl.[6] ..... H01R 9/03

[52] U.S. Cl. ..... 439/610; 439/108

[58] Field of Search ..... 439/607–610, 439/101, 108

[56] References Cited

U.S. PATENT DOCUMENTS

| | | | |
|---|---|---|---|
| 3,999,830 | 12/1976 | Herrmann, Jr. et al. | 439/610 |
| 4,236,779 | 12/1980 | Tang | 439/610 |
| 4,386,819 | 6/1983 | Asick et al. | 439/610 |
| 4,398,780 | 8/1983 | Novotny et al. | 439/610 |
| 4,592,612 | 6/1986 | Kikuta | 439/610 |
| 4,838,808 | 6/1989 | Fujiura | 439/610 |
| 5,195,909 | 3/1993 | Huss, Jr. et al. | 439/465 |

FOREIGN PATENT DOCUMENTS

| | | |
|---|---|---|
| 0474184A1 | 3/1992 | European Pat. Off. . |
| 2424644 | 11/1979 | France . |

*Primary Examiner*—Hien Vu

*Attorney, Agent, or Firm*—Sughrue, Mion, Zinn, Macpeak & Seas, PLLC

[57] ABSTRACT

The invention concerns a branch connector device for a shielded cable connecting a plurality of stations of a land network. The device comprises:

a junction box (Bi) comprising a housing, an electromagnetic shield (EBi) and two entries for two respective sections (Ci, C'i) of the shielded cable;

a connector (Mi) comprising a plurality of contacts and an electromagnetic shield.

According to the invention the housing of the junction box forms the housing of the connector; the shield (EBi) of the junction box also forms the shield of the connector; and the conductors of each section of the cable are connected directly to the contacts of the connector. Applicable to industrial data processing.

11 Claims, 4 Drawing Sheets

Ci
C'i
23
24
22
21
26
25
37
36
35
Si
28
29
29'
30
21, 22
27

40
41
42
43
44
45
46
47
49
39
Ci
Ci'
59
59'
25
65,66
67
68
61
63
70
79
71
72
73
74
75
76
77
78
80
50
51
53
54
55
56
56'
58,58'
59, 59'
60
60'
62
64
65
66
73,74
81
82

BRANCH CONNECTOR DEVICE FOR A SHIELDED CABLE

The invention concerns a branch connector device for a shielded cable, forming a land bus for interconnecting industrial apparatuses which send or receive data, so as to form a network.

BACKGROUND OF THE INVENTION

Such a shielded cable generally comprises a plurality of insulated conductors surrounded by an electromagnetic shield, formed by a conductive braid. A branch connector device is used to connect each piece of apparatus to the bus cable.

French patent application No. 2 424 644 describes a branch connector device formed by a connector which makes it possible to connect the same piece of apparatus both to an outgoing cable and an incoming cable. That connector comprises a plurality of contact parts each of which receives a conductor of the outgoing cable and a conductor of the incoming cable, the ground contact of the connector being connected to the shields of the two cables. The two cables are retained by clamping in the metal housing of the connector or by a crimped ferrule. That device is not really suitable for industrial use, because it does not ensure good retention of the two cables. Branch connector devices used on industrial sites need to be more robust.

Each branch connector device conventionally comprises a junction box, a branch cable, and a connector on the end of the branch cable for plugging into a complementary connector on the apparatus. A conventional junction box thus has three entries: two entries for two respective sections of the shielded cable, and an entry for the branch cable. The branch cable is itself a cable shielded by an electromagnetic shield.

To provide good protection for the transmitted data, it is necessary to make connections between the shields of all the shielded cables connected to the same junction box. In addition, this has to comprise an electromagnetic shield forming a Faraday cage around the devices which connect the conductors transmitting the data. For example, in the case of the land bus known under the name FIP and of the land bus known under the name WORLD FIP, the NF C46 604 and IEC 1158-2standards determine the rules of physical interconnection, allow the matching of the data transmission lines to be maintained, and provide the cable shields with convenient interconnection and with connection to ground. Finally, the junction box comprises an insulating housing in order to avoid the possibility of personnel using the network coming into contact with the shield potential of the cables.

Various types of junction boxs are known. For example French patent application No. 2 676 695 describes a connector box which can meet those standards.

However the branch connector devices implemented by means of conventional branch junction boxes all suffer from the disadvantages of substantial size and cost, because there are three cables which are interconnected two sections of the bus cable of the network and the branch cable individual to each branch connector device.

SUMMARY OF THE PRESENT INVENTION

The object of the present invention is to provide a branch connector device more robust than that described in French patent application No. 2 424 644 but having a size and cost less than those of conventional devices implemented by means of a junction box of known type and which can be installed on site without the need for special tooling, which observes the standards for interconnection of land network cables, and which allows repairs or later modifications.

The present invention provides a branch connector device for a shielded cable comprising at least one insulated conductor and an electromagnetic shield; the device comprising:

- a junction box comprising a housing, an electromagnetic shield lining the housing and two entries for two respective sections of the shielded cable;
- a connector comprising a housing, an insulating body carrying a plurality of contacts, and an electromagnetic shield surrounding the insulating body and the contacts;
- and means for connecting each section of the shielded cable to the contacts of the connector;
- characterized in that the housing of the junction box also forms the housing of the connector;
- in that the means for connecting each conductor of each section of the cable to the contacts of the connector are formed by the ends themselves of the conductors of the two sections of the cable;
- and in that the shield of the housing comprises:
  - connection means for effecting mechanical and electrical connection of the shield of the housing and the shield of the connector;
  - at least one strap for effecting contact with the shield of each section of the shielded cable;
  - and clamping means for clamping each strap on the bared shield of each section.

The device thus characterized has a small size and reduced cost, because there are only two cables to be connected—the two sections of the main cable. There is no branch cable. Also the parts count is reduced since only one housing and one shield are common to the junction box and connector. However, it ensures good retention of the cable sections and complete continuity of the shield of the housing and the shield surrounding the insulating body and the contacts of the connector. The cable sections are each retained by:

- at least one strap which also makes contact with the shield of the box;
- and clamping means for clamping each strap on the bared shield of each section of the cable.

The continuity of the shield of the housing and the shield of the connector is reliable because the connection is both mechanical and electrical. These two shields are fixed together and thus act as a single, continuous shield, even in the presence of mechanical stresses, due to a pull on one of the two cable sections for example.

In a preferred implementation, a branch connector device comprising two screws for fixing the branch connector device to a piece of apparatus after inserting the connector in a complementary connector of the apparatus, the two screws being parallel to the direction of insertion and withdrawal of the connector and lying in a plane passing through the connector, is characterized in that the two entries and each strap are located in a plane parallel to but offset relative to the plane of the screws, to allow the two sections of the shielded cable to enter the housing parallel to each other and perpendicular to the direction of insertion and withdrawal and lying in a plane parallel to but offset relative to the plane of the screws.

The device thus characterized makes it possible for the two cable sections to extend perpendicular to the insertion/ withdrawal direction of the connector while nevertheless allowing rigid fixing of the device to a piece of apparatus, by means of the two screws.

In a preferred embodiment, the electromagnetic shield common to the junction box and the connector comprises:

- two parts, each part comprising at least one strap for effecting contact with the shield of each shielded cable section;
- clamping means for clamping each strap on the bared shield of each section, and for effecting electrical connection of the two parts of the shield common to the junction box and the connector; and
- fixing means for fixing at least one of the two parts of the shield to the connector and connecting it to a ground contact of the connector.

The device thus characterized is particularly simple and economic to manufacture, since two metal parts form both a shield for the housing, a shield surrounding the insulating body and the contacts of the connector, and means interconnecting the shields of the two cable sections.

BRIEF DESCRIPTION OF THE DRAWING

The invention will be better understood and other characteristics will appear from the following description and the accompanying drawings.

DETAILED DESCRIPTION OF THE INVENTION

Figure 1:
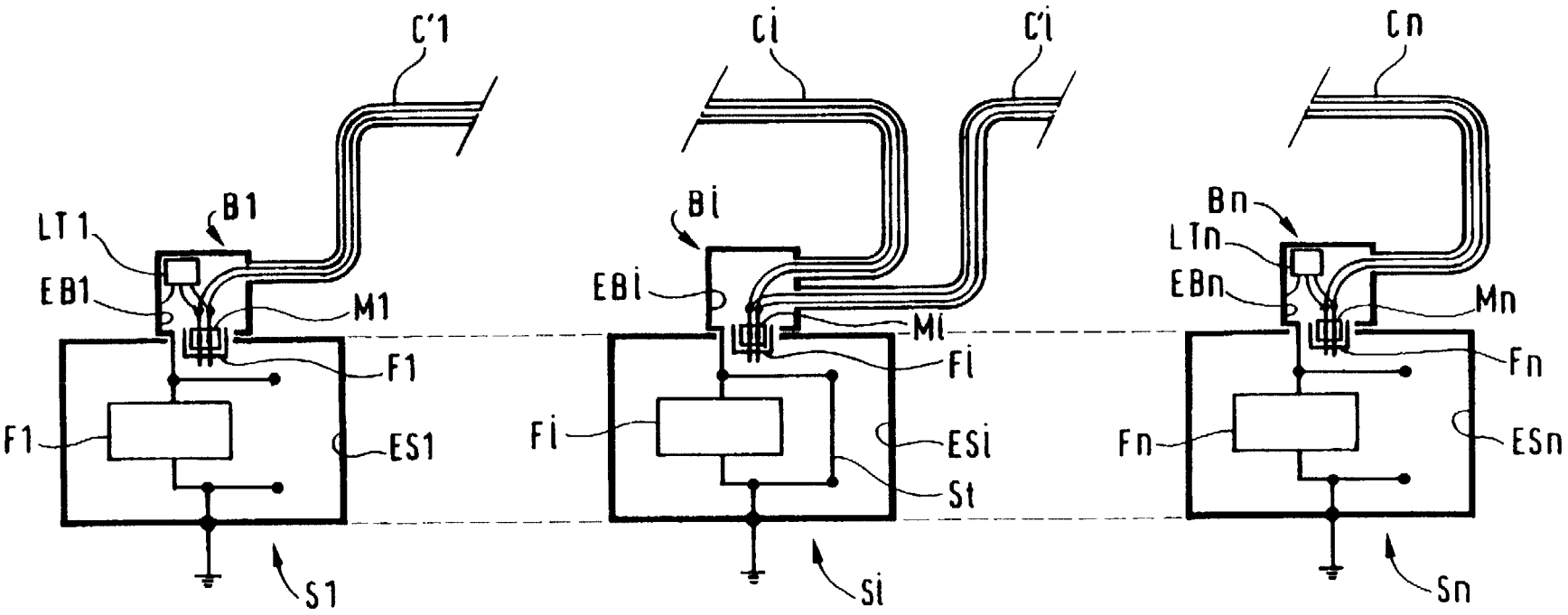
FIG. 1 is a block diagram of one example of a land network including branch connector devices of the invention.

The example of the land network shown in FIG. 1 comprises n stations S1 . . . . , Si, . . . . , Sn, connected together by a bus cable formed by a pair of conductors, shielded by an electromagnetic shield. For example, the station Si is connected on one side to a section Ci of this shielded cable and on the other side to a section C'i of this same shielded cable. For this station Si, the branch connector device Di is formed essentially of a junction box Bi and a male connector Mi, the two pairs of conductors of the sections Ci and C'i being connected in parallel to two contacts of the connector Mi. The connector Mi is inserted in a complementary connector Fi, located on the station Si and having two contacts connected to various electronic circuits, not shown.

The housing of the connector box B1 also forms the housing of the connector Mi. There is no branch cable to connect the connector Mi to the junction of the two sections Ci and C'i of the shielded cable. The two pairs of conductors of the sections Ci and C'i are connected directly to the two contacts of the connector Mi.

The junction boxes B1, . . . . , Bi, . . . . , Bn are provided with respective electromagnetic shields EB1, . . . . , EBi, . . . . , EBn. The stations S1, . . . . , Si, . . . . , Sn are provided with respective electromagnetic shields ES1, . . . . , ESi, . . . . , ESn which are all connected to the respective local ground connections.

FIG. 1 shows the interconnections between the various electromagnetic shields and the terminations of the transmission line formed by the bus cable. The electromagnetic shields of all the sections of the bus cable and all the junction boxes are connected together but are not connected to the electromagnetic shields of the stations, except at a single station located approximately in the center of the transmission line, being the station Si for example. In all of the stations other than the station Si, the electromagnetic shield of the junction box is connected to local ground through a filter. All of the stations S1, . . . . , Si, . . . . , Sn are provided with a respective conventional filter F1, . . . . , Fi, . . . . , Fn for this purpose. Only the filter Fi is short-circuited by a jumper St to make a direct connection to ground. The filters F1 and Fn, for example, are not short-circuited.

The stations S1 and Sn in this example are at the ends of the transmission line formed by the bus cable. In order to minimize distortion of the signals transmitted on the bus cable, a conventional line termination LT1 is provided in the junction box B1 and a conventional line termination LTn in the junction box Bn, associated with the stations S1 and Sn respectively. The junction box B1 is connected to a single cable section Cl. The line termination LT1 has two inputs connected to the two conductors respectively of the cable section Cl and a third input is connected to the electromagnetic shield EB1 of the box B1. The junction box Bn is connected to a single cable section Cn. The line termination LTn has two inputs connected to the two conductors respectively of the cable section Cn and an input is connected to the electromagnetic shield EBn of the box Bn.

Figures 2, 3:
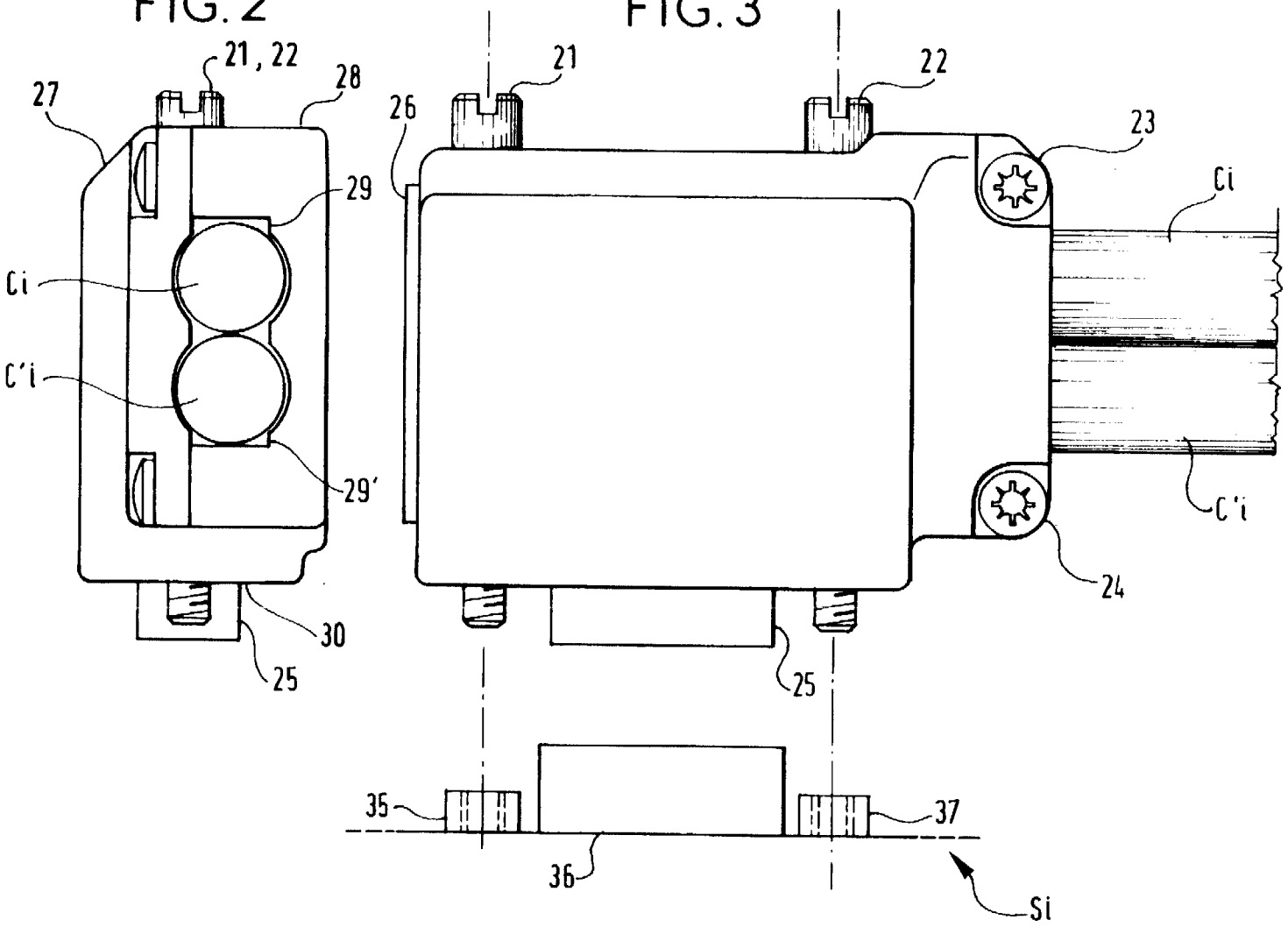
FIGS. 2 and 3 are a right side view and a front view respectively of an embodiment of the branch connector device of the invention, when it connects to a station which is not at an end of the bus cable.

FIG. 2 and FIG. 3 are a left side view and a front view respectively of an embodiment of the branch connector device of the invention. This embodiment comprises a connector Mi represented in the present invention by element 25 and a junction box Bi comprising:

- a housing of plastics material, formed by a bottom 28 and a cover 27 linked together by a thin leaf 26 acting as a hinge;
- two screws 23 and 24 for closing the housing; and
- two captive screws 21 and 22 for fixing the branch connector device to a station Si.

The connector Mi passes through the wall of the housing 27, 28 via an opening represented by the element 30.

Two sections Ci and C'i of the shielded cable pass into the housing through openings 29, 29', being parallel to one another and perpendicular to the direction of insertion and withdrawal of the connector 25. The openings 29 and 29' are cut into a side of the bottom 28 of the housing, in such a manner that the sections Ci and C'i can be placed therein when the cover 27 is open and that the cover 27 also acts as a cable clamp. The outer insulating sheath 60, 60' of the cable sections Ci and C'i is trapped between the cover 27 and the bottom 28 when the screws 23 and 24 are screwed into the bottom. The general shape of the housing 27, 28 is flat and the two cable sections Ci and C'i lie in the plane of the housing. The captive screws 21 and 22 pass through the housing parallel to this plane. They are located on the two sides of the connector 25. They are screwed into two threaded parts 35 and 37 on the station Si, after the connector 25 has been inserted into a complementary connector Fi represented in the present invention by element 36 located on the station Si.

The bus cable is covered by a conventional insulating sheath 60, 60'. When the connector 25 is inserted in the complementary connector 36, the personnel using the network cannot come into contact with the metal parts forming the electromagnetic shields inside the housing 27, 28 and inside the cable sections Ci and C'i.

The entry of the cable sections Ci and C'i perpendicular to the direction of insertion and withdrawal of the connector 25 has two advantages:

The size is reduced compared with entry in the direction of insertion and withdrawal, since the cable sections Ci and C'i run parallel to the face of the station Si carrying the connector 36, instead of projecting perpendicular to this face.

Manipulation of the captive screws 21 and 22 is easier, because the user who is installing the screws is not hindered by the presence of the cable sections, which enter the housing between the two screws.

Figures 4, 5:
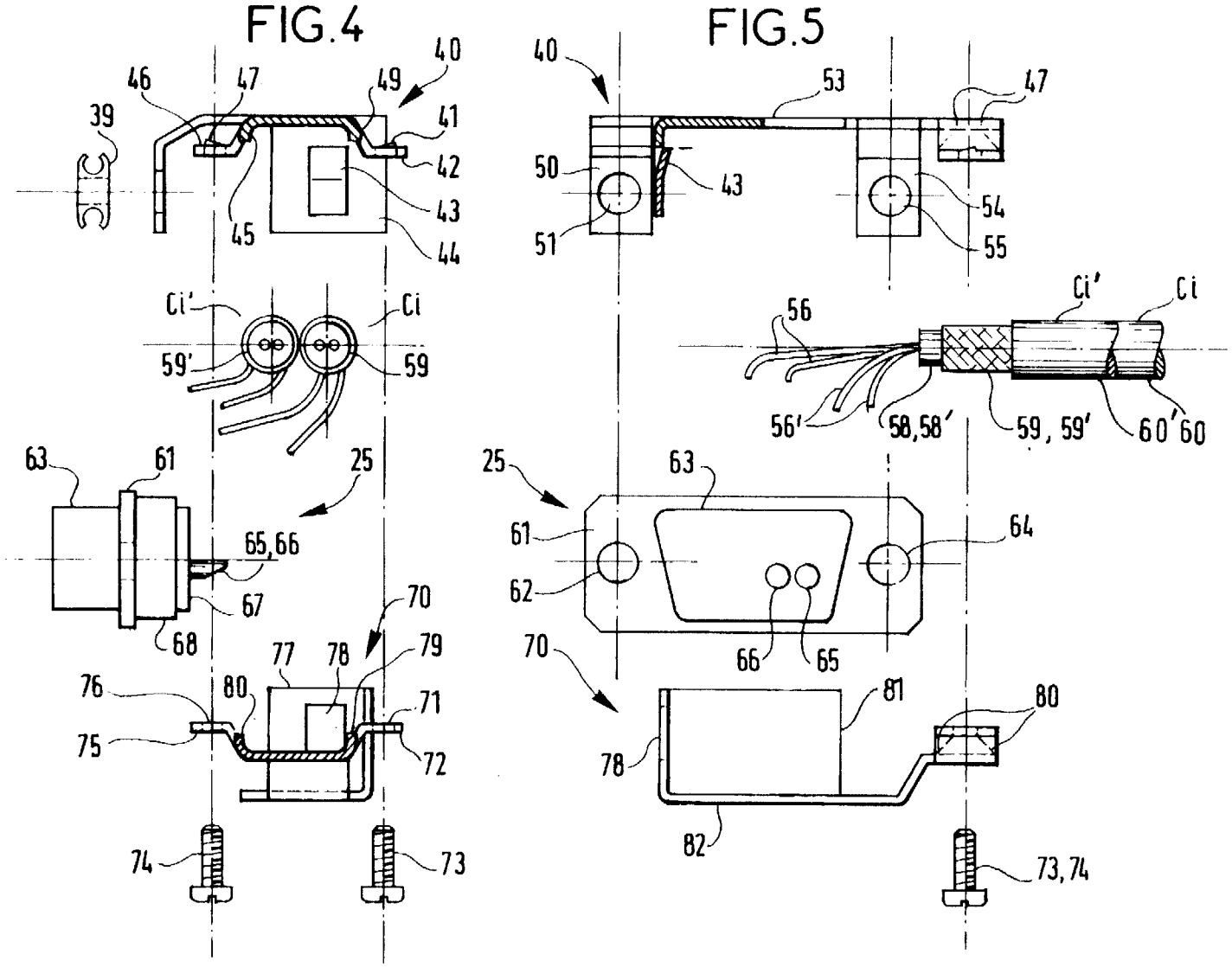
FIGS. 4 and 5 are exploded left side and front views respectively of part of this embodiment.

FIGS. 4 and 5 are a left side view and a front view of some of the parts which form this embodiment. The housing 27, 28 is assumed to be removed and the parts are exploded for greater clarity. The cable sections Ci, C'i are each formed by an outer insulating sheath 60, 60'; a shield 59, 59' which is a metal braid; a polyester tape 58, 58' aluminized on the inside; and a pair of twisted conductors 56, 56' which are individually insulated.

Two metal parts 40 and 70 are fitted together and attached by two screws 73, 74, so as to form an electromagnetic shield common to the junction box Bi and the connector 25. It protects the two pairs of conductors 56, 56' at the ends of the cable sections Ci, C'i and protects the contacts 65, 66 of the connector 25. The shield is formed mainly by two flat faces 44 and 53 of the part 40 and three flat faces 77, 81 and 82 of the part 70. One side of the shield is formed by a shield plate 61 of the connector 25 and one side is free for entry of the cable sections Ci and C'i, this entry being protected by the shields 59 and 59' of the cable sections.

The part 40 has a tongue 43 of rectangular shape, cut in the flat face 44 and lug which to form a locking lug which engages in a rectangular opening 78 cut in a flat face 77 of the part 70. When the parts 40 and 70 are assembled, the tongue 43 is retained in the opening 78 and the flat faces 44 and 77 are connected together. At the other end of the part 40 from the tongue 43, a strap is formed by tabs 42 and 46 having threaded holes 41 and 47 respectively therethrough. At the other end of the part 70 from the face 77, another strap formed by two tabs 72 and 75 has two holes 71 and 76 allowing passage of the two screws 73 and 74. When the two screws are fitted, the straps 41–46 and 72–75 form a cable clamp for clamping the two cable sections Ci and C'i at the same time, these being stripped of their outer insulating layer to expose the metal braids 59, 59' forming the shields of these cable sections. It should be noted that the strap 42–46 is provided with two teeth 45 and 49 and the strap 72–75 is provided with two teeth 79 and 80, for penetrating the metal braids 59, 59', so as to ensure good contact between the shields of the cable sections Ci and C'i and the shield common to the junction box Bi and the connector 25.

The connector 25 is fixed to the part 40 by means of two tubular rivets 39. To this end the part 40 has two tabs 50 and 54 with through holes 51 and 55 and the shield plate 61 of the connector 25 has two through holes 62 and 64. It should be noted that the tubular rivets 39 have a diameter which allows passage of the captive screws 21 and 22 shown in FIG. 3. The riveting is done in the factory.

The connector 25 comprises an insulating body 67 with receptacles, into which contacts are inserted, namely two contacts 65 and 66, to which are soldered the ends of the two pairs of conductors 56 and 56' of the two sections Ci and C'i of the shielded cable. The insulating body 67 is retained by a crimped metal part 68 integral with the shield plate 61. A skirt 63 is fixed to the shield plate 61 on the face to the outside of the housing of the junction box, in order to form an electromagnetic shield protecting the contacts of the connector. This skirt 63 also forms the ground contact. In this embodiment, the contacts 65, 66 are soldered contacts but other kinds of implementation may involve crimped contacts on the ends of the pairs of conductors 56, 56'. In neither case does the fitting need special tools.

Installation on site consists first of all in preparing the ends of the two cable sections Ci and C'. Then the ends of the two pairs 56, 56' are soldered to the contacts 65 and 66. Then the electromagnetic shield is closed by assembling the parts 40 and 70, engaging the tongue 43 in the opening 78, screwing the two screws 73 and 74 and checking that the straps 42–46 and 72–75 make good contact with the shields 59, 59'. Then the whole assembly of the parts 40, 70 and the connector 25 are enclosed in the housing by means of the two screws 23 and 24 and checking that the two parts 27, 28 of the housing bear firmly against the insulating sleeves 60, 60'.

Figure 6:
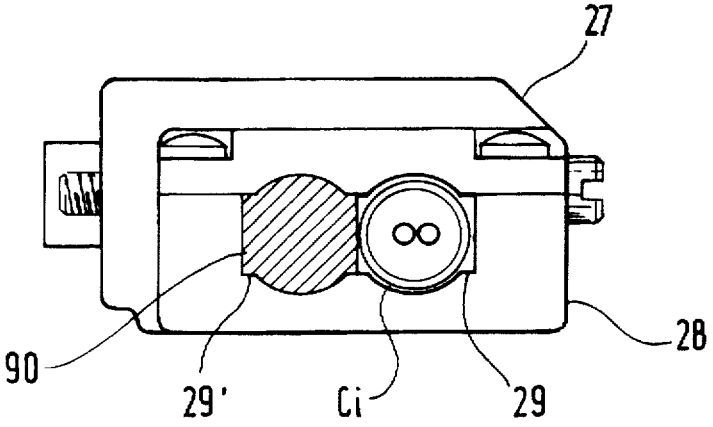
FIGS. 6 and 7 are a view from below and a front view respectively of this embodiment when it is used at the end of a transmission line.
Figure 7:
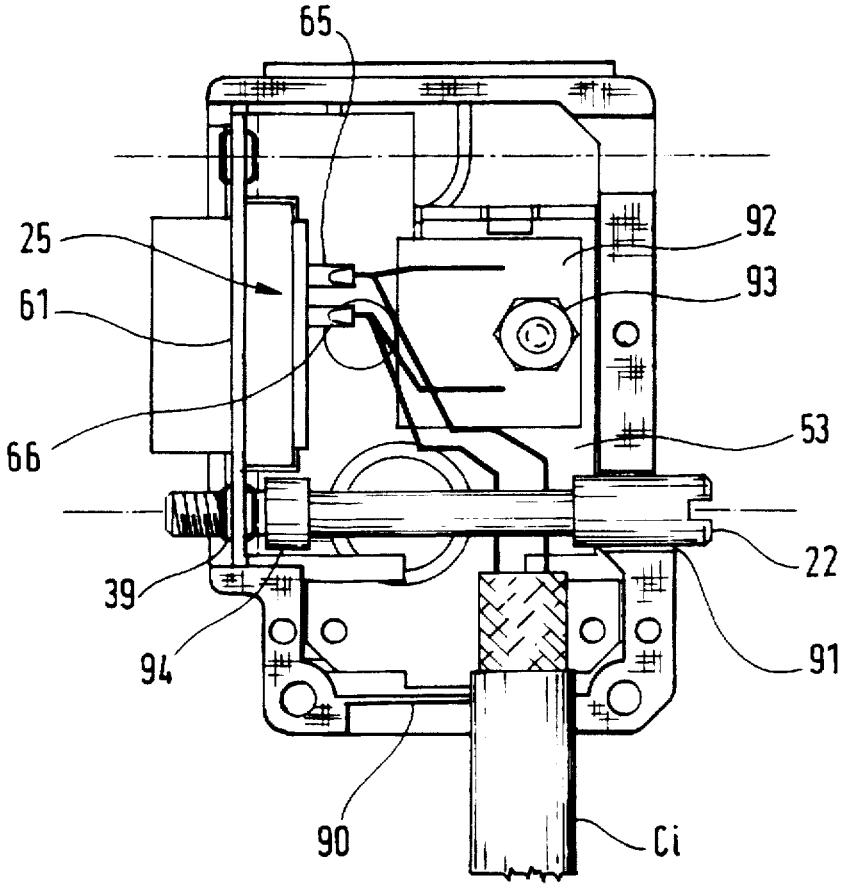

FIGS. 6 and 7 show an embodiment of the device of the invention in a view from below and a front view respectively, for the station S1 at one end of the bus cable, comprising a junction box B1 and a connector M1 represented by the element 25. In FIG. 7 the top 27 of the housing is assumed to be removed to show the arrangement of the parts inside the junction box B1.

A single cable section Cl enters the housing through the opening 29, the opening 29' being blocked by a thin wall 90 of plastics material. The housing is made with a wall 90 and this is removed on site by means of ordinary flat nose pliers if a second cable section is to enter the connector box. In the opposite case, the wall 90 is left in place in order to block the opening 29' and prevent intrusion of foreign bodies into the junction box. The wall 90 is shown hatched in FIG. 6.

FIG. 7 shows that the junction box B1 contains a line termination 92, which is fixed to the flat face 53 of the part 40 by means of a screw 93, which also serves to establish electrical connection between one input of the termination 92 and the part 40, which is connected to ground via the connector 25, more specifically through the skirt 63 of the connector 25. The other parts are identical to those described above and have the same reference numerals.

FIG. 7 also shows the form of the captive screws 21 and 22. The screw 22 for example comprises a collar 94 which retains the screw 22 within the housing when the cover 27 is closed over the bottom 28. The end with a thread passes through the shield plate 61 of the connector 25, through a tubular rivet 39. The other end of the screw 22, which has a slot for a screwdriver, passes through the sidewall of the bottom 28, through an opening 91 which is intersected by the parting plane of the cover 27 and the bottom 28, in order to allow the fitting of the screw 22 in spite of the presence of the shoulder 94. The captive screw 21 is identical to the screw 22.

The invention is not restricted to the two embodiments described above. In particular it lies within the competence of the person skilled in the art to modify the arrangement of the parts of the device to provide access for the two cable sections in a direction parallel to the direction of insertion and withdrawal of the connector, or to connect another kind of shielded cable having a number of conductor other than two.

We claim:

1. A branch connector device, including a junction box and a connector, for a shielded cable having at least one insulated conductor and an electromagnetic shield, the device comprising:

a housing (27,28) formed by two connecting parts so that one part forms a cover for said housing and upon connection of the two parts a pair of entries are formed for receiving two respective sections of the shielded cable.

an electromagnetic shield (40,70) lining said housing, wherein said junction box is contained within said housing;

said connector having an insulating body (67) carrying a plurality of contacts (65, 66), and an electromagnetic shield (63, 61, 68) surrounding said insulating body and said contacts, wherein said connector is contained within said housing;

means for connecting each conductor of the two respective sections of the shielded cable to said contacts of said connector, wherein said means for connecting each conductor of the two respective sections to said contacts is formed by the ends of each conductor;

said electromagnetic shield (40, 70) of said housing including a connection means (39, 50, 54) for effecting mechanical and electrical connection of said electromagnetic shield (40, 70) of said housing and said electromagnetic shield (63, 61, 68) of said connector;

said electromagnetic shield (40, 70) of said housing having at least one strap (42–46, 72–75) for effecting contact with the electromagnetic shield (59, 59') of the two respective sections of the shielded cable; and a clamping means (73, 74) for clamping said at least one strap on a bared shield of the two respective sections of the shielded cable.

2. A branch connector device according to claim 1, further comprising two screws (21, 22) for fixing the branch connector device to a piece of apparatus after inserting said connector (25) in a complementary connector (36) of the apparatus, said two screws being parallel to the direction of insertion and withdrawal of said connector and lying in a plane passing through said connector wherein the two entries (29, 29') and said at least one strap (42–46, 72–75) are located in a plane parallel to but offset relative to the plane of said screws (21, 22), to allow the two respective sections (Ci, C'i ) of the shielded cable to enter said housing parallel to each other and perpendicular to the direction of insertion and withdrawal of said connector and lying in a plane parallel to but offset relative to the plane of said screws (21, 22).

3. A branch connector device according to claim 1, wherein the electromagnetic shield of said housing comprises two parts (40, 70) and said clamping means (73, 74) for clamping said at least one strap on the bared electromagnetic shield of the two respective sections connect the two parts (40, 70) of said electromagnetic shield of said housing electrically together.

4. A branch connector device according to claim 1, wherein said junction box (Bi) comprises:

a passageway formed for said connector (Mi);

a means (23, 24) for fixing the two parts (27, 28) of said housing together; and a means (21, 22) for fixing the assembled device to a complementary connector (Fi) complementary to said connector (Mi) of the branch connector device.

5. A branch connector device according to claim 2, wherein said electromagnetic shield of said housing is formed in two parts (40, 70) and comprises two straps (42–46, 72–75) for making contact between each part and the shield (59, 59') of each of the two respective sections of the shielded cable; and a means (73, 74) for drawing said two straps towards each other, so as to clamp the two respective sections of the shielded cable between said two straps and to establish contact with the shields (59, 59') of the two respective sections.

6. A branch connector device according to claim 1, wherein said housing contains a line termination (92).

7. A branch connector device according to claim 1, wherein said electromagnetic shield of said housing has teeth for providing connection of the two respective sections of the shielded cable.

8. A branch connector device according to claim 1, wherein said electromagnetic shield of said housing is formed by two separate parts, each having a plurality of flat faces and a plurality of through holes so that said through holes align together for connecting the two separate parts together wherein at least one screw fits through said through holes.

9. A branch connector device according to claim 1, wherein said housing has a rectangular and flat shape and the assembly of the cover part and the bottom part forms a cut out shaped for receiving two circular shaped cables in parallel.

10. A branch connector device according to claim 4, wherein said complementary connector is a filter.

11. A branch connector device comprising:

a housing having a first and second passageway passing through perpendicular planes and an electromagnetic shield lined within said housing;

a junction box contained within said housing;

a connector received through said first passageway, having an insulating body and another electromagnetic shield; and a means for electrically and mechanically connecting said electromagnetic shield of said housing and said another electromagnetic shield together, wherein a shielded cable is received within said second passageway for electrical connection within said junction box.

* * * * *